US010397996B2

(12) United States Patent
Gershowitz et al.

(10) Patent No.: US 10,397,996 B2
(45) **Date of Patent: *Aug. 27, 2019**

(54) INRUSH ENERGY CONTROL FOR A LIGHT EMITTER

(71) Applicant: SIGNIFY HOLDING B.V., Eindhoven (NL)

(72) Inventors: Michael N. Gershowitz, San Jose, CA (US); Vladimir Odnoblyudov, Danville, CA (US)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 15/214,265

(22) Filed: Jul. 19, 2016

(65) Prior Publication Data

US 2016/0330817 A1 Nov. 10, 2016

Related U.S. Application Data

(63) Continuation of application No. 14/562,645, filed on Dec. 5, 2014, now Pat. No. 9,420,658.

(51) Int. Cl.
*H05B 37/02* (2006.01)
*H05B 33/08* (2006.01)

(52) U.S. Cl.
CPC ..... *H05B 33/0845* (2013.01); *H05B 33/0803* (2013.01); *H05B 33/0812* (2013.01); *H05B 33/0857* (2013.01); *H05B 33/0884* (2013.01); *H05B 37/0272* (2013.01)

(58) Field of Classification Search
CPC ..... H05B 33/0851; H05B 33/0812; H05B 33/0845; H05B 33/0884; H05B 33/0803; H05B 33/0857; H05B 37/0272
USPC ..... 315/297
See application file for complete search history.

(56) References Cited

U.S. PATENT DOCUMENTS

| | | | | |
|---|---|---|---|---|
| 8,975,833 | B2 * | 3/2015 | Han | H05B 33/0815 315/294 |
| 2008/0012508 | A1 | 1/2008 | Steele | |
| 2008/0218100 | A1 | 9/2008 | Parikh | |
| 2010/0109554 | A1 | 5/2010 | Lecheler et al. | |
| 2010/0253245 | A1 | 10/2010 | Du | |
| 2010/0308727 | A1 * | 12/2010 | Verjans | G09G 3/14 315/51 |
| 2011/0227489 | A1 | 9/2011 | Huynh | |
| 2012/0146538 | A1 | 6/2012 | Nerone | |
| 2013/0038242 | A1 * | 2/2013 | Athalye | H05B 33/0815 315/297 |
| 2015/0077020 | A1 | 3/2015 | Lin | |

(Continued)

*Primary Examiner* — Don Le
(74) *Attorney, Agent, or Firm* — Stephen M. Kohen

(57) ABSTRACT

A lighting module configured to be powered by an external driver includes a light emitting diode (LED) array, and a control circuit configured to control current initially applied by the external driver to the LED array. A lighting system includes a driver configured to provide a constant current power supply and a plurality of lighting modules coupled to the driver. Each lighting module includes a light emitting diode (LED) array, and an integrated control module including an attenuator configured to attenuate current initially applied by the driver to the LED array in response to a received control signal, and a processor configured to generate the control signal to the attenuator.

12 Claims, 13 Drawing Sheets

(56) References Cited

U.S. PATENT DOCUMENTS

2015/0115830 A1 4/2015 Siessegger
2015/0366025 A1* 12/2015 Oraw ..... H01L 27/15
315/294

* cited by examiner

VIEW OF TOP OF LAM/ICM ASSEMBLY
(PERSPECTIVE TOP VIEW)

VIEW OF TOP OF LAM/ICM ASSEMBLY
(PERSPECTIVE TOP VIEW)

VIEW OF BOTTOM OF LAM/ICM ASSEMBLY
(PERSPECTIVE VIEW)

TOP-DOWN VIEW OF LAM/ICM ASSEMBLY
(TOP-DOWN VIEW)

TOP-DOWN VIEW OF ONE EXAMPLE OF A LAM
(SHOWN WITHOUT PHOSPHOR LAYER)

THE LAM FITS UP INTO THE CENTRAL OPENING IN THE
BOTTOM OF THE ICM AND IS FIXED IN PLACE
(CROSS-SECTIONAL SIDE VIEW OF ASSEMBLY)

BOTTOM-UP VIEW OF ICM SHOWING CONTACT PADS ON THE INSIDE LIP OF THE ICM

DETAIL OF A CONTACT PAD OF THE LAM MAKING CONTACT WITH A CONTACT PAD ON THE BOTTOM OF THE INSIDE LIP OF THE ICM

CROSS-SECTIONAL VIEW TAKEN ALONG LINE A-A'
(SHOWN ON A HEAT SINK)

CROSS-SECTIONAL VIEW TAKEN ALONG LINE B-B'
(SHOWN ON A HEAT SINK)

CROSS-SECTIONAL VIEW TAKEN ALONG LINE C-C'
(SHOWN ON A HEAT SINK)

CROSS-SECTIONAL VIEW TAKEN ALONG LINE D-D'
(SHOWN ON A HEAT SINK)

INRUSH ENERGY CONTROL FOR A LIGHT EMITTER

CROSS-REFERENCE TO RELATED APPLICATIONS

This application is a continuation of U.S. patent application Ser. No. 14/562,645 entitled "Inrush Energy Control for a Light Emitter", filed Dec. 5, 2014, allowed, the content of which is hereby incorporated by reference in its entirety.

BACKGROUND

Field

The present disclosure relates generally to solid state light emitters, and more particularly, to inrush energy control for solid state light emitters.

Background

Solid state light emitters, such as light emitting diodes (LEDs), are becoming the favored choice for general lighting applications over incandescent lamps and fluorescent fixtures for their lower power demand. An LED converts electrical energy to light. Light is emitted from active layers of semiconductor material sandwiched between oppositely doped layers when a voltage is applied across the doped layers. In order to use an LED chip, the chip is typically enclosed along with other LED chips in a package. In one example, the packaged device is referred to as an LED array. The LED array includes an array of LED chips mounted onto a heat conducting substrate. A layer of silicone in which phosphor particles is embedded is typically disposed over the LED chips. Electrical contact pads are provided for supplying current into the LED array and through the LED chips so that the LED chips can be made to emit light. Light emitted from the LED chips is absorbed by the phosphor particles, and is re-emitted by the phosphor particles so that the re-emitted light has a wider band of wavelengths.

As a solid state device, solid state light emitters are operated by direct current (DC) voltage. A constant current DC driver may be used as the power source to one or more solid state lighting fixtures. Conventional power control for such an arrangement includes switching AC input line voltage to the DC driver on or off, using a manual wall switch for example. For large lighting installations where remote power control of many lighting fixtures is sought from a central location, maintaining individualized control capability is desirable for flexibility of the lighting system operation. A local control circuit within each lighting fixture is needed to provide enhanced network control of a lighting system.

A local control circuit can provide independent control for each light fixture. However, switching a power supply at the load side presents a risk of inrush current damage to the light emitters when first powered up. This may occur if a filter capacitor at the output of the power supply driver keeps a residual charge after opening the switch to the load. Switching at the supply side of the driver surrenders the ability to maintain continuous power at the internal control circuit. Internal switching with inrush current protection is needed.

SUMMARY

In an aspect of the disclosure, an apparatus includes a light emitting diode (LED) array member configured to be coupled to an external driver, and an integrated control module, which includes an attenuator configured to attenuate current initially applied by the external driver to the LED array member in response to a received control signal, and a processor configured to generate the control signal to the attenuator.

In an aspect of the disclosure, an apparatus includes an LED array member configured to be coupled to an external driver, and a control circuit configured to control current initially applied by the external driver to the LED array member.

In another aspect of the disclosure, a system includes a driver configured to provide a constant current power supply, a plurality of lighting modules coupled to the driver. Each lighting module includes a light emitting diode (LED) array member configured to be coupled to the driver, and an integrated control module, which includes an attenuator configured to attenuate current initially applied by the driver to the LED array member in response to a received control signal. Each lighting module further includes a processor configured to generate the control signal to the attenuator.

It is understood that other aspects of apparatuses and methods will become readily apparent to those skilled in the art from the following detailed description, wherein various aspects of apparatuses and methods are shown and described by way of illustration. As will be realized, these aspects may be implemented in other and different forms and its several details are capable of modification in various other respects. Accordingly, the drawings and detailed description are to be regarded as illustrative in nature and not as restrictive.

DETAILED DESCRIPTION

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known structures and components are shown in block diagram form in order to avoid obscuring such concepts.

The word "exemplary" is used herein to mean serving as an example, instance, or illustration. Any embodiment described herein as "exemplary" is not necessarily to be construed as preferred or advantageous over other embodiments. Likewise, the term "embodiment" of an apparatus, method or article of manufacture does not require that all embodiments of the invention include the described components, structure, features, functionality, processes, advantages, benefits, or modes of operation. The phrase "coupled to" used herein relates to an electrical connection between two elements, and not necessarily a mechanical connection.

Figure 1:
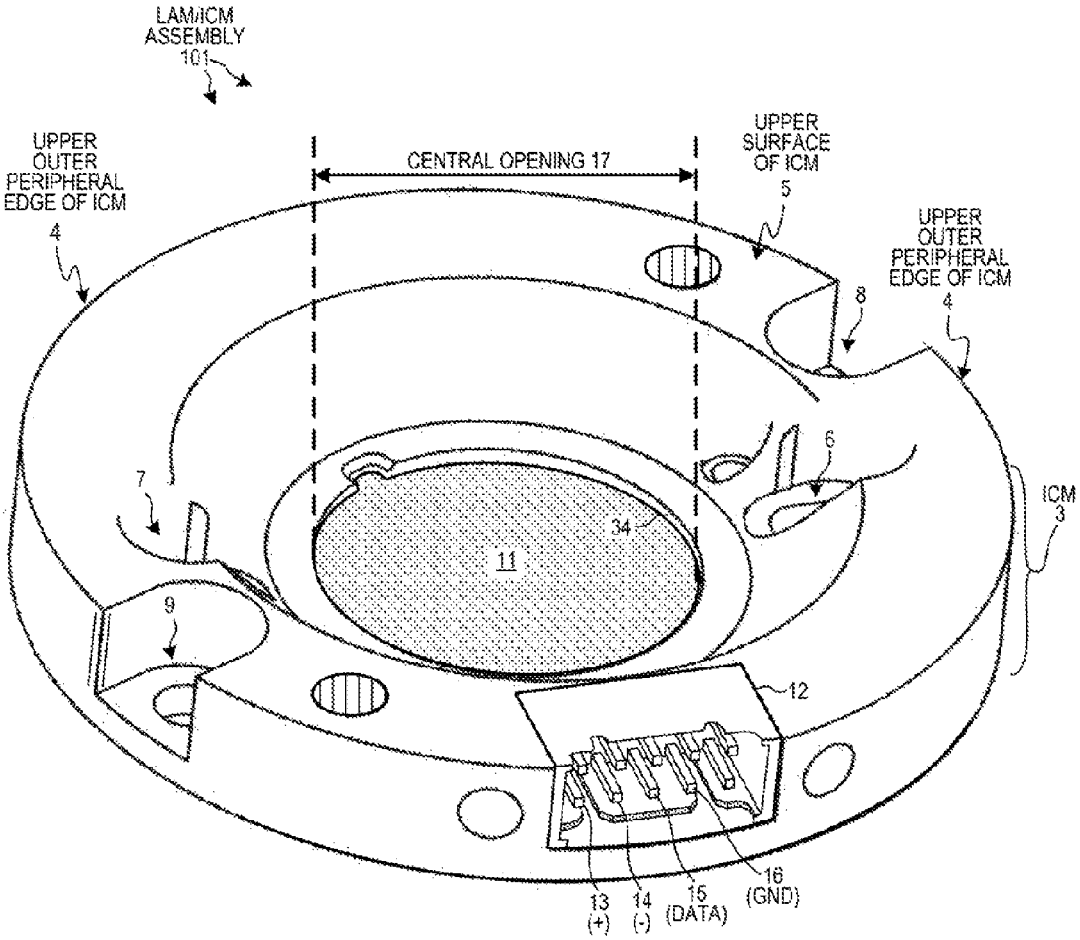
FIG. 1 is a perspective view of the connector side of the top of an exemplary LED array member (LAM)/integrated control module (ICM) assembly.
Figure 2:
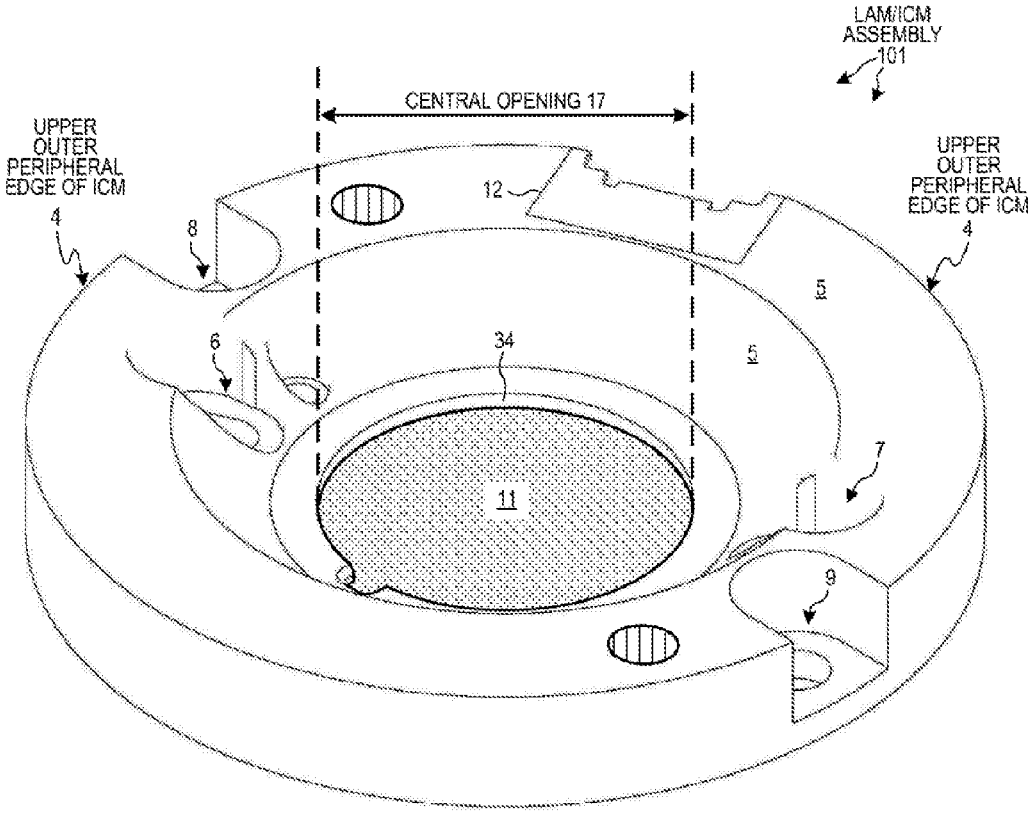
FIG. 2 is a perspective view of the top of an exemplary LED array member (LAM)/integrated control module (ICM) assembly from the side opposite the connector.

FIGS. 1-2 show perspective views of the top of an LED assembly member/integrated control module assembly (LAM/ICM assembly) 101. There are two parts of the LAM/ICM assembly: a LED assembly member 102 (FIG. 3) and an integrated control module 3. The LED assembly member 102 is hereinafter referred to as the LAM. The integrated control module 3 is hereinafter referred to as the ICM. As illustrated in the diagram, the LAM/ICM assembly 101 is a disk-shaped structure that has a circular upper outer peripheral edge 4.

Figure 6:
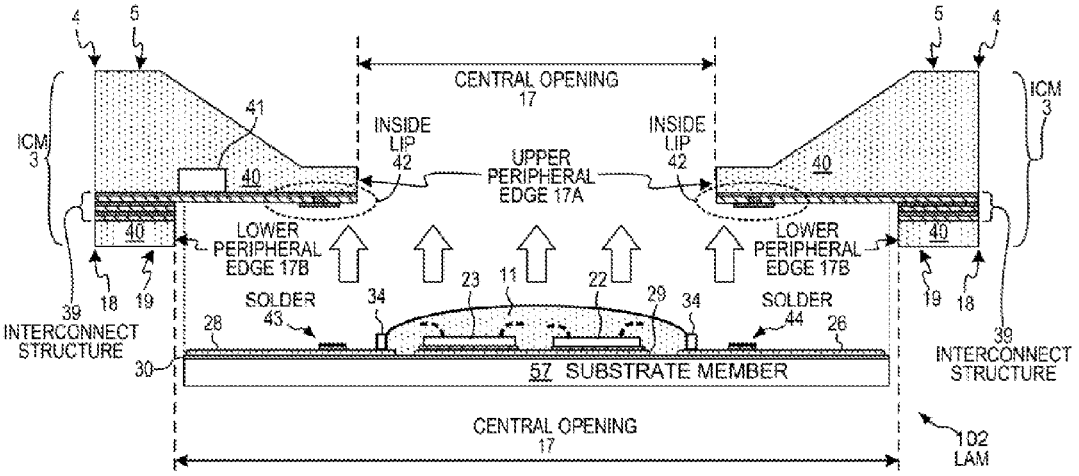
FIG. 6 is cross-sectional view showing how the exemplary LAM fits up and into the central opening in the ICM.

LAM/ICM assembly 101 includes an upper surface 5 of a molded plastic encapsulant 40 (FIG. 6). Two sets of two holes 6-9 are provided through which threaded screws or bolts (not shown) can extend to fix the LAM/ICM assembly 101 to a heat sink. The disk-shaped shaded object in the center in the illustration is a disk-shaped amount of silicone 11. The silicone 11 has phosphor particles embedded in it. This silicone with the embedded phosphor particles overlies an array of light emitting diodes (LEDs). The LEDs are not seen in the diagram because they are disposed under the silicone. The LAM/ICM assembly 101 further includes a header socket 12 and ten header pins, such as pins 13, 14, 15 and 16. Pin 13 is a power terminal through which a supply voltage or a supply current is received into the LAM/ICM assembly 101. Pin 14 is a power terminal through which the current returns and passes out of the LAM/ICM assembly. Pin 14 is a ground terminal with respect to the power terminal 13. Pin 15 is a data signal terminal through which digital signals are communicated into and/or out of the LAM/ICM assembly. Pin 16 is a signal ground for the data signals communicated on pin 15. The illustrated example of the LAM/ICM assembly 101 that has ten header pins is but one example. In other examples, fewer or more header pins are provided in the header socket 12, and assignment of power or signals to the pins can be on different positions than illustrated herein. If the LEDs underneath silicone 11 are powered and emitting light, then the light passes upward through the central circular opening 17 in upper surface 5, and is transmitted upward and away from the LAM/ICM assembly 101.

Figure 3:
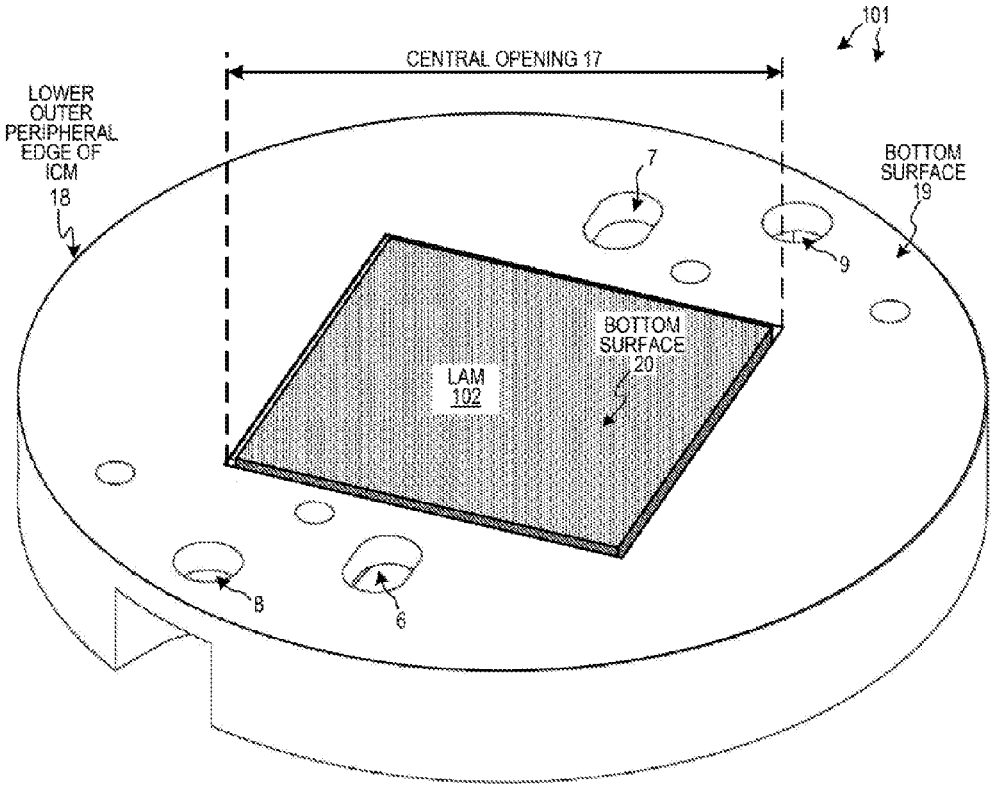
FIG. 3 is a perspective view of the bottom of the exemplary LAM/ICM of FIGS. 1 and 2.

FIG. 3 is a perspective view of the bottom of the LAM/ICM assembly 101, showing a circular lower outer peripheral edge 18 of the LAM ICM assembly 101. Whereas the shape of central opening 17 at the upper surface 5 of the ICM is circular as pictured in FIG. 1, the shape of the central opening 17 at the bottom surface 19 of the ICM as pictured in FIG. 3 is square. The LAM 102 is disposed in the central opening 17 so that the bottom surface 20 of the LAM 102 protrudes just slightly from the plane of the bottom surface 19 of the ICM 3. From the perspective of the illustration of FIG. 3, the bottom surface 20 of the LAM is slightly higher than is the bottom surface 19 of the ICM. The bottom surface 20 of the LAM is actually the bottom surface of a substrate member 57 of the LAM (FIG. 6).

Figure 4:
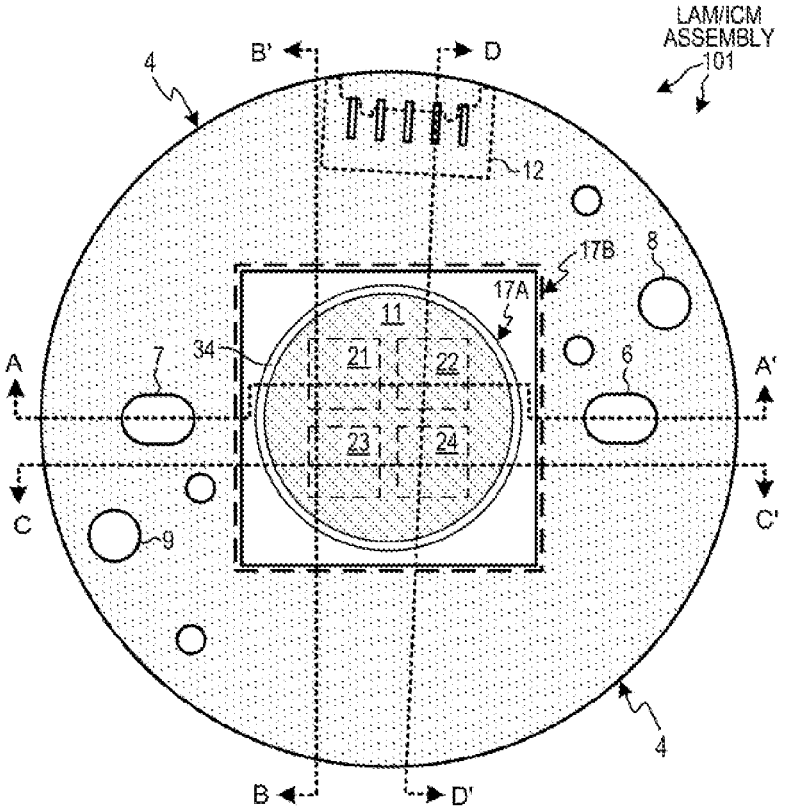
FIG. 4 is a cross-sectional, top-down view of the exemplary LAM/ICM assembly of FIGS. 1 and 2.

FIG. 4 is a cross-sectional, top-down diagram of the LAM/ICM assembly 101. The round circle identified by reference numeral 17A is the edge of circular central opening 17 at the upper surface of the ICM. The dashed square identified by reference numeral 17B is the edge of the square-shaped central opening 17 at the bottom surface of the ICM. The four dashed squares 21-24 identify where four LED dice are disposed underneath the silicone 11.

Figure 5:
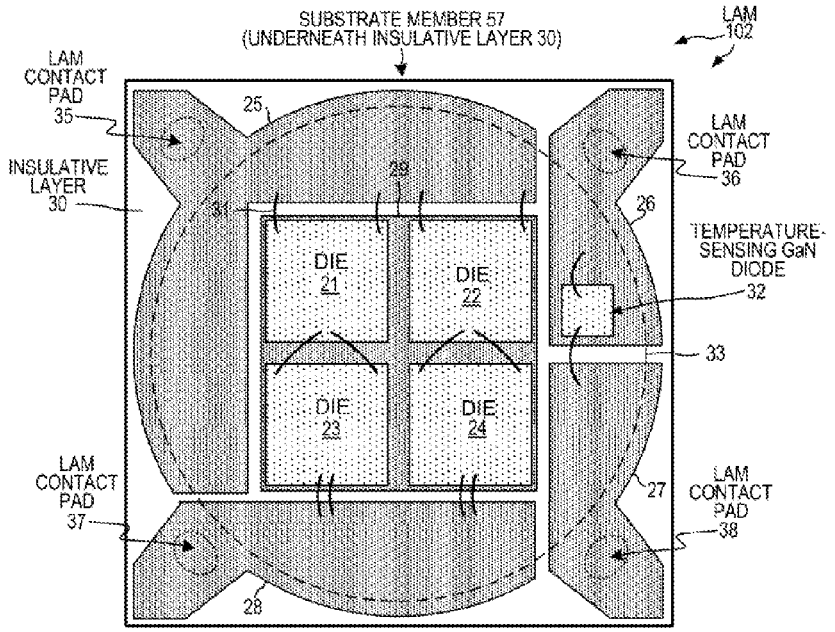
FIG. 5 is top-down view of an exemplary LAM usable with the ICM of FIGS. 1 and 2.

FIG. 5 is a simplified top-down diagram of one example of LAM 102, where the silicone and solder mask layers are not shown so that the metallization patterns of die attachment of LED dice 21-24 can be seen. There are five areas of metal 25-29 disposed on an insulative layer 30, where the insulative layer 30 in turn is disposed on the substrate member 57. The insulative layer 30 insulates each of the metal areas from the substrate member 57 of the LAM. The substrate member 57 in this case is a square piece of aluminum sheet. The four LED dice 21-24 are lateral LED dice that are die-attached to the central metal area 29. The LED dice are wire bonded to form two parallel strings. An LED drive current can flow through the first string by flowing from metal area 25, through LED die 21, through LED die 23, and to metal area 28. An LED drive current can flow through the second string by flowing from metal area 25, through LED die 22, through LED die 24, and to metal area 28. Reference numeral 31 identifies one of the bond wires. In addition to LED dice 21-24, LAM 102 includes a temperature sensing GaN diode die 32. In one example, this GaN diode die 32 is of identical construction to the LED dice. In the illustrated example, it is of identical construction except for the fact that it is a smaller die. The anode of GaN diode 32 is coupled via a bond wire to metal area 26. The cathode of GaN diode 32 is coupled via another bond wire to metal area 27. The dashed line 33 identifies the circular outer periphery of a rim 34 that retains the silicone 11. As can be seen from FIGS. 1, 2 and 4, this rim 34 is of a diameter that is just smaller than the inside diameter of the central opening 17 in the upper surface of the ICM. LAM contact pads 35-38 are shown as outwardly extending portions of the metal areas at the corners of the LAM 102. In this example, the LAM contact pads 35-38 have areas of metal that are exposed, and are not covered with soldermask.

FIG. 6 is a cross-sectional diagram that shows how the LAM 102 fits up into the central opening 17 in the ICM 3. ICM 3 includes an interconnect structure 39, a plurality of electronic components that are mounted to the interconnect structure, and the amount of insulative molded plastic encapsulant 40 that encases and encapsulates the interconnect structure 39 and one or more electronic components 41. In the illustrated example, the interconnect structure 39 is a multi-layer printed circuit board (PCB). The entire printed circuit board may not be completely encapsulated. For example, the bottom of the inside lip 42 of the central opening 17 may be uncovered with encapsulant so that portions of metallization on this lip 42 can serve as ICM contact pads. Each of the LAM contact pads on the top of the LAM 102 is soldered to corresponding one of the ICM contact pads on the downward facing inside lip 42 of the ICM. In this example, amounts 43 and 44 of solder paste are disposed on the LAM contact pads, and the LAM 102 is moved up and into contact with the ICM 3, and then the assembly is heated in a reflow soldering process to solder the LAM contact pads to the ICM contact pads. Other soldering and mechanical/electrical interface methods such as conductive adhesives could be used instead of reflow soldering with solder paste as described herein.

Figure 7:
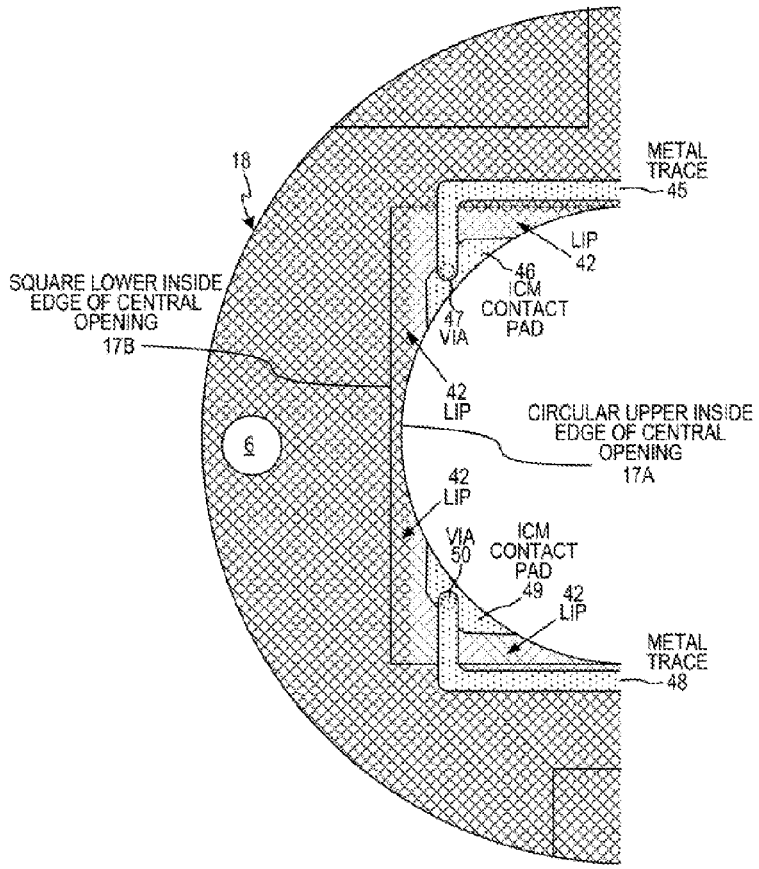
FIG. 7 is a diagram showing an exemplary ICM contact pad disposed on the inside lip of the ICM.

FIG. 7 is a view of the bottom of the ICM 3. Metal traces of the printed circuit board 39 extend to the inside lip 42 and connect to ICM contact pads through conductive vias. For example, trace 45 may contact ICM contact pad 46 through conductive via 47. Trace 48 may contact ICM contact pad 49 through conductive via 50.

Figure 8:
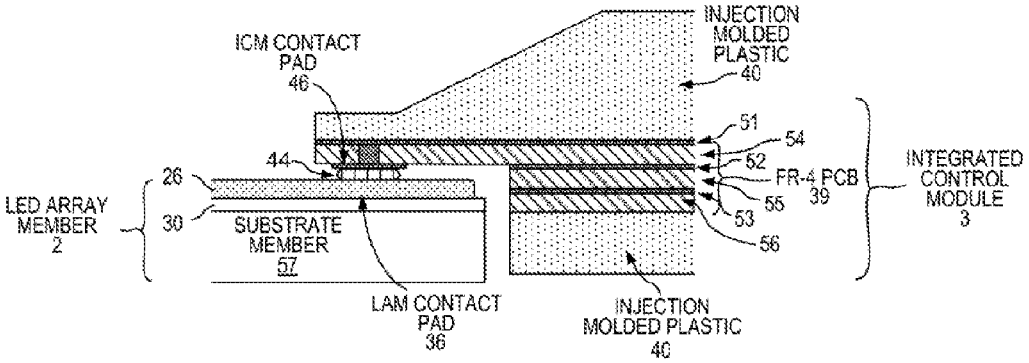
FIG. 8 is a more detailed diagram showing an exemplary LAM contact pad on the peripheral edge of upper surface of the LAM making contact with a corresponding ICM contact pad.

FIG. 8 is a view that shows how LAM contact pad 36 may be coupled via solder 44 to the corresponding ICM contact pad 46 on the inside lip of the ICM. The PCB 39 includes three metal layers 51, 52 and 53 and three fiberglass layers 54, 55 and 56. The substrate member 57 of the LAM 102 may be covered by insulative layer 30. The metal area 26, a part of which is LAM contact pad 36, may be electrically coupled to ICM contact pad 46, up through solder 44 and through a conductive via in the PCB, and to metal interconnect layer 51 of the PCB 39. The interconnect structure described herein is that of a conventional FR-4 PCB; however, other structures such as Kapton "flex circuit" or metal clad PCB circuits may also be used for this interconnect structure.

Figure 9:
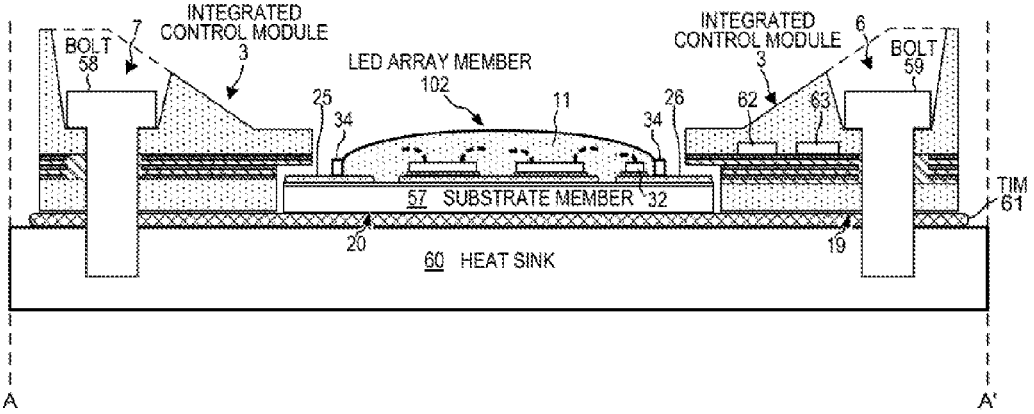
FIG. 9 is a cross-sectional view taken along line A-A' of the exemplary LAM/ICM of FIG. 4.

FIG. 9 is a cross-sectional view of the LAM/ICM assembly 101 of FIG. 4 taken along sectional line A-A' (shown on a heat sink 60). Bolts 58 and 59 extend through holes 6-7, and hold the bottom surface 20 of LAM 102 in good thermal contact with the heat sink 60 through a layer 61 of a thermal interface material (TIM). There are no LAM contact pads or ICM contact pads in the cross-section illustrated. Electronic components 62 and 63 of control circuitry are mounted on PCB 39. The circuitry may be over-molded by the injection molded plastic encapsulant 40.

Figure 10:
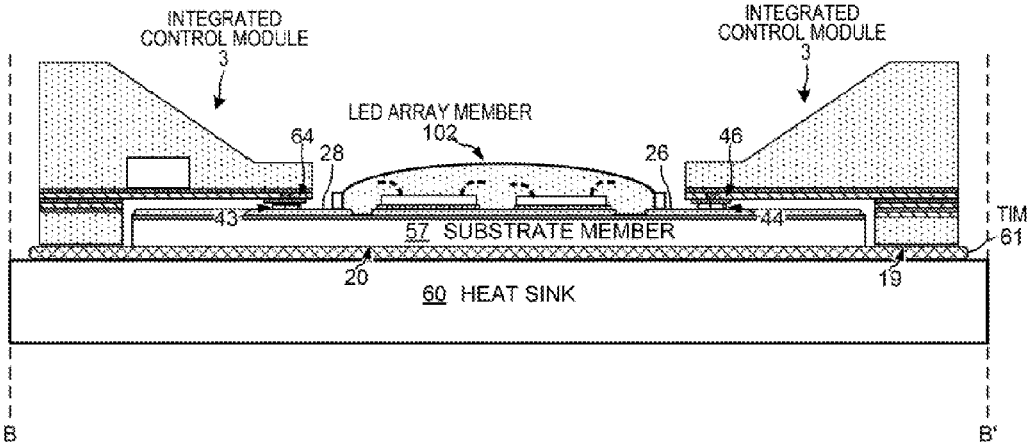
FIG. 10 is a cross-sectional view taken along line B-B' of the exemplary LAM/ICM of FIG. 4.

FIG. 10 is a cross-sectional view of the LAM/ICM assembly 101 of FIG. 4 taken along sectional line B-B' (shown on a heat sink). Solder 43 may electrically couple LAM contact pad 37 to ICM contact pad 64. Solder 44 may electrically couple LAM contact pad 36 to ICM contact pad 46.

Figure 11:
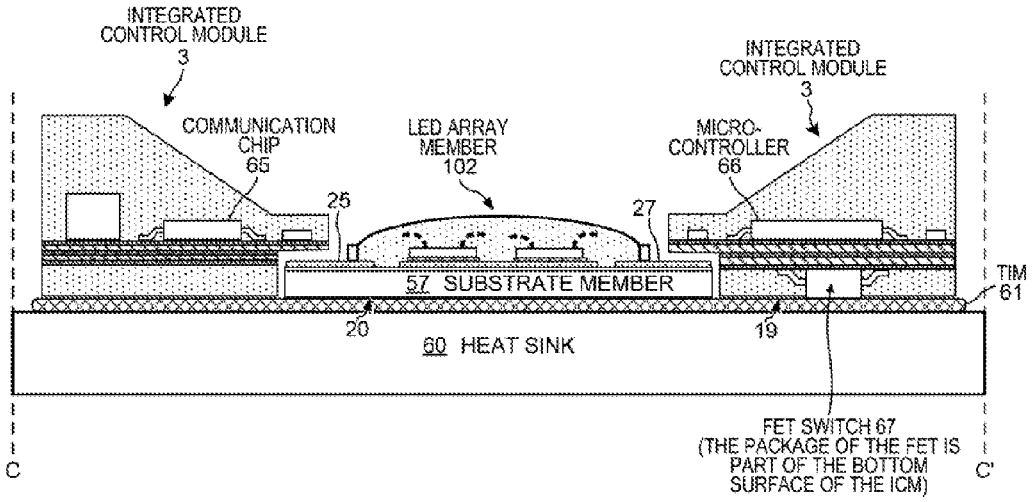
FIG. 11 is a cross-sectional view taken along line C-C' of the exemplary LAM/ICM of FIG. 4.

FIG. 11 is a cross-sectional view of the LAM/ICM assembly 101 of FIG. 4 taken along sectional line C-C' (shown on heat sink 60). Electronic components 65, 66 and 67 of a control circuit are mounted on PCB 39. Each of these three components 65-67 may be a packaged device that is in turn over-molded by the plastic encapsulant 40 of the ICM. In the case of component 67, a surface of the package forms a part of the bottom surface of the ICM so that when the ICM is pressed against the heat sink 60 (with the TIM 61 in between), the bottom surface of the packaged device makes good thermal contact with the heat sink 60. The component 67 may, for example, be a DCB-isolated SMPD (direct copper bonded isolated surface mount power device) package having downward facing surface which is a heat-dissipating substrate that is intended to be pressed against a heat sink.

Figure 12:
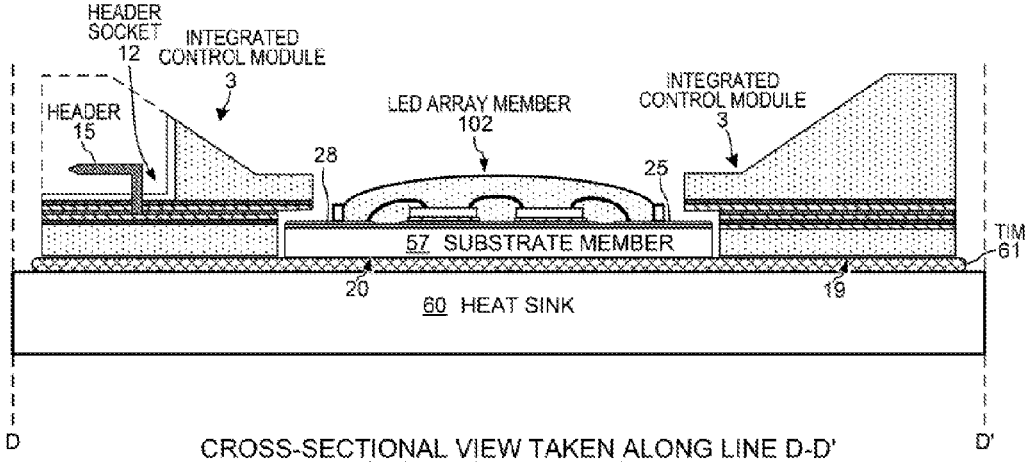
FIG. 12 is a cross-sectional view taken along line D-D' of the exemplary LAM/ICM of FIG. 4.

FIG. 12 is a cross-sectional view of the LAM/ICM assembly 101 of FIG. 4 taken along sectional line D-D' (shown on a heat sink).

The LAM/ICM assembly 101 may be implemented as a lighting module within a lighting system of multiple lighting modules that are interconnected. Each lighting module may be controllable for ON/OFF control, as well as dimming and monitoring of LED parameters (e.g., surface temperature) to maintain the lighting module within acceptable operating ranges to minimize aging and degradation and to optimize performance. For example, since each lighting module includes an ICM 102 having a processor 66 and communication IC 65, each lighting module may be individually controlled within the lighting system using a communication network.

Figure 13:
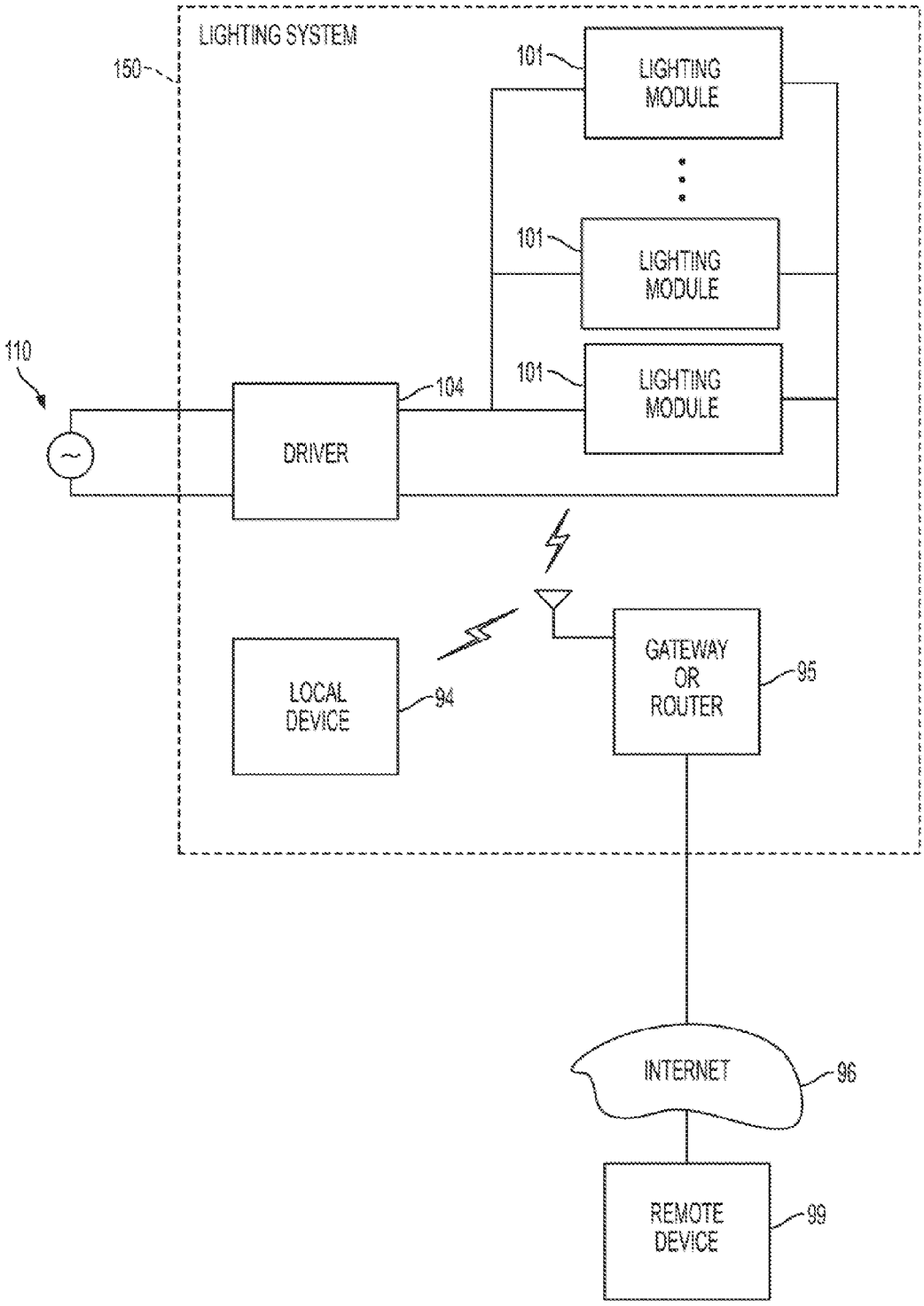
FIG. 13 shows a block diagram of an exemplary lighting system with a single lighting apparatus.

FIG. 13 shows a lighting system 150 that includes multiple lighting modules 101. Each lighting module 101 may implemented as the LAM/ICM assembly 1 as shown in FIGS. 1-12. A standard AC line voltage source 110 (e.g., 110 VAC) supplies a driver 104 configured to convert AC to DC supply power to supply DC constant current to the lighting modules 101. Power control, (i.e., ON/OFF switching) and dimming control to each lighting module 101 may be sent wirelessly via a control signal using antenna 98 of a gateway or router 95. In this example, the gateway or router 95 may receive a control signal from a remote device 99 over the Internet 96 for delivery to the gateway or router 95 via an Ethernet connection or some other suitable connection 97. Alternatively, a local device 94 may send a control signal directly to the gateway or router 95 via a wired or wireless local area network. Alternatively, the local device 94 may be hardwired to the gateway or router 95. This modular arrangement of lighting modules 101 allows a local device 94 or remote device 99 to control each lighting module 101 individually within the entire lighting system 150 from a single location or control point. Also, the modular configuration allows for easy expansion of the lighting system 150 as each lighting module 101 contains its own control circuitry. With expansion, one or more additional drivers 104 may be added to the lighting system 150 depending on the load limit capacity of the driver 104.

Figure 14:
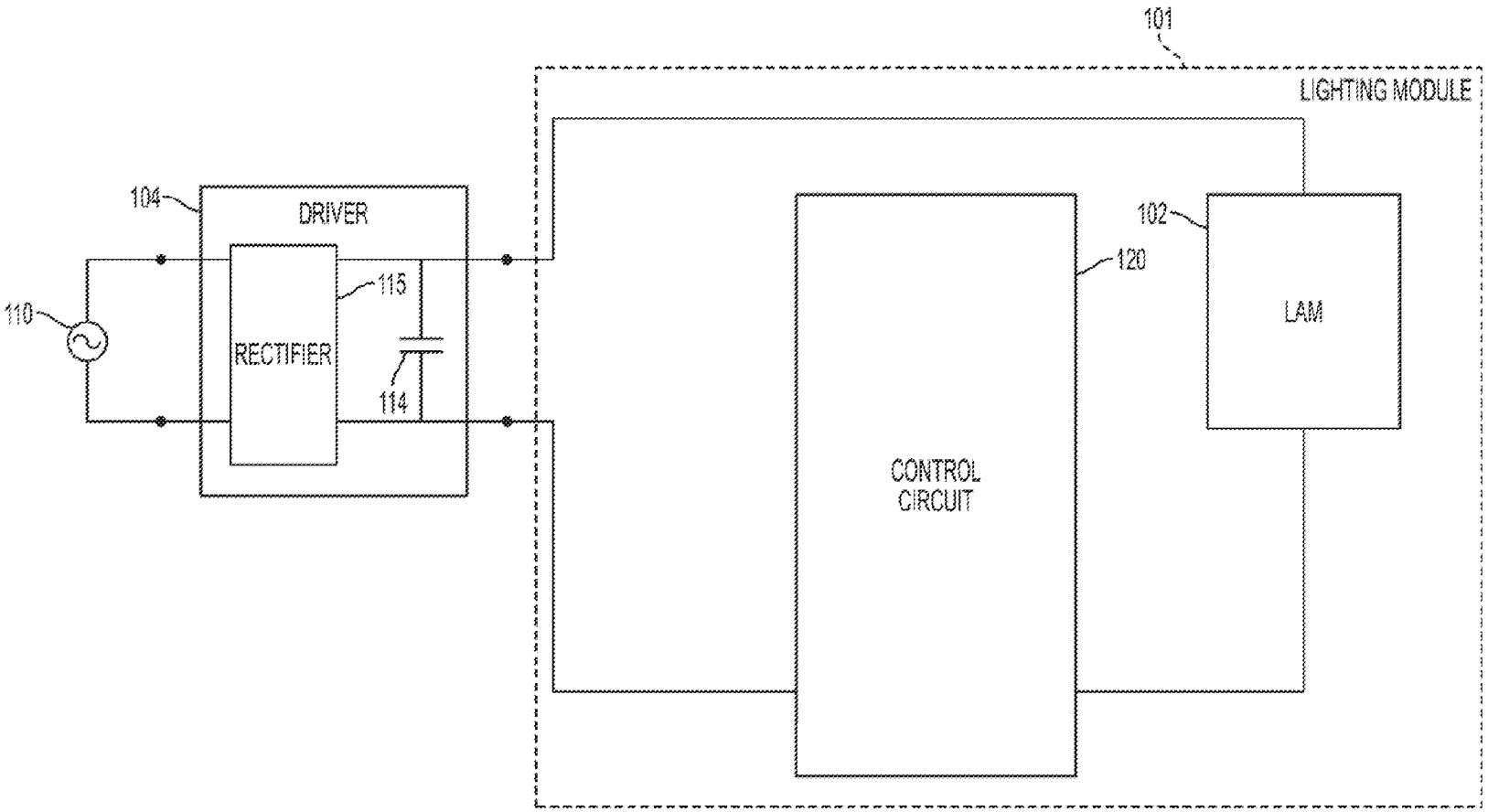
FIG. 14 shows a block diagram of an exemplary lighting apparatus including a local control circuit for a solid state light emitter.

FIG. 14 shows an exemplary control circuit 120 for the lighting module 101. A driver 104 is configured as an AC-to-DC power supply that provides adjustable constant current to the LAM 102. An output capacitor 114 in driver may be used to stabilize the output DC current from the rectifier 115 of the driver 104. A control circuit 120 may control may switch current flow at the load side of driver 104 for ON/OFF control of the LAM 102. The control circuit 120 may be powered by a local DC voltage source. For example, a linear voltage regulator may take DC voltage output from the driver 104 and convert it to a low voltage supply to the control circuit 120.

Figure 15:
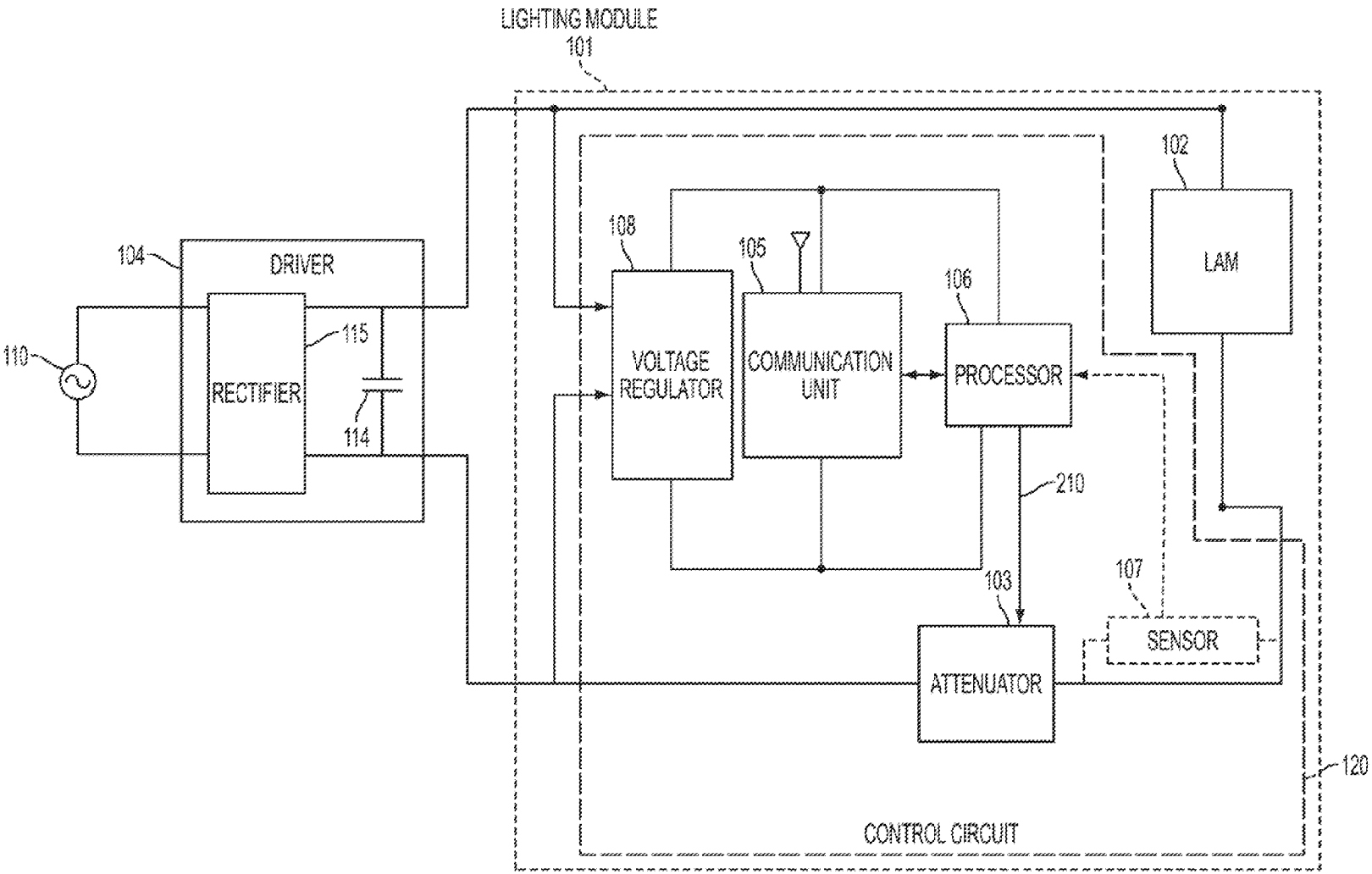
FIG. 15 shows a block diagram of an exemplary lighting apparatus with the local control circuit shown in greater detail.

FIG. 15 shows the control circuit 120 in further detail. An attenuator 103 may be configured include a transistor, such as a field effect transistor (FET), that may be controlled to switch the supply current open or closed between the driver and the LAM 102 in response to an ON/OFF control signal from the processor 106. In the example of a FET attenuator 103, the control signal may adjust a gate voltage and/or drain voltage to operate the current flow through the FET for ON/OFF control. The attenuator 103 may also have a controllable impedance value that may be adjusted to attenuate inrush current to the LAM 102 after the control circuit switches the LAM 102 ON. For example, the attenuator 103 may include a transistor that may be operated by a control signal for adjusting the impedance for decreasing and increasing the current supply to the LAM 102. As another example, the attenuator 103 may include a FET that is controllable at the gate voltage and/or the drain voltage to control current flow through the attenuator within safe levels for the LAM 102.

In the example of the control circuit 120 implemented within the ICM 3 shown in FIGS. 1-12, the attenuator 103 may be arranged on the PCB 39 as component 67 as shown in FIG. 11.

A voltage regulator 108 is arranged to provide a stepped-down control voltage (e.g., 3 VDC) for the control circuit contained internally within the lighting apparatus 101, which includes a communication unit 105 and a processor 106. The communication unit 105 is configured to receive a wireless control signal from a local or remote device. In the example of the control circuit 120 being implemented as the ICM 3 shown in FIG. 1-12, the communication unit 105 may be arranged on the PCB 30 as component 65 shown in FIG. 11.

The processor 106 is configured to control the attenuator 103 by sending an instruction signal based on the remote control signal. For example, the processor 106 may send a control signal to the attenuator 103 as a control voltage that switches the attenuator to a conductive state, allowing the LAM 102 to be energized. This control signal may be in response to a remote control signal received from device 94, 99 and forwarded from communication unit 105 containing an instruction to turn ON the LAM 102. As a another example, in response to a remote control signal to turn OFF the LAM 102, the processor 106 may send a control signal that triggers the attenuator to shut down and act as an open switch, deenergizing the LAM 102. In the example of the control circuit 120 implemented within the ICM 3 shown in FIGS. 1-12, the processor 106 may be arranged on the PCB 39 as component 66 as shown in FIG. 11.

The communication unit 105 may be configured to transmit a feedback signal to the device 94, 99 to indicate the ON/OFF status of the LAM 102. The feedback signal may be triggered upon a change of ON/OFF state, or may be periodically sent in regular intervals to report current ON/OFF state, or a combination of both.

When attenuator 103 opens the power connection to the driver 104, in response to an OFF remote control signal, the output capacitor 114 may maintain a full charge as the driver 104 attempts to output the constant current to an open circuit. Subsequently, when the attenuator 103 is switched ON by the processor 106 control signal, the capacitor 114 may rapidly discharge, sending an inrush current through the LAM 102. For an initial operation of the control circuit 120, the processor 106 may control the attenuator 103 to allow inrush current to flow for a controlled period of time, for example 10-200 μsec, so that the processor 106 may monitor the inrush current profile. The processor 106 may limit the inrush period to be brief enough to avoid exposure of the LAM 102 to a full peak inrush current. The driver 104 may have a characteristic inrush current profile for a peak current over time. Once the processor 106 learns the characteristic profile for the driver 104, the processor may generate an adaptive control signal that controls the attenuator 103 to absorb the energy of the inrush current each time the control circuit 120 operates to turn the LAM 102 ON, and adjust the attenuator 103 to gradually reduce the resistance once a steady state current from the driver 104 is established, following the inrush period.

To learn the inrush profile for the driver, the processor 106 may be configured to run a series of testing cycles until the peak current period for the current profile of the driver is ascertained. Each time the control circuit 120 operates to turn ON the LAM, the processor 106 may use the opportunity for a testing cycle. For example, in a first testing cycle, the processor 106 may select a first time period (e.g., 10 μsec) for the inrush current, and may allow attenuator 103 to operate in a full conductive mode for 10 μsec., monitoring a first peak inrush current (e.g., 5 A). After the first time period elapses, the processor 106 may control the attenuator 103 to operate in a resistive mode to reduce the inrush current to a safe level (e.g., to 0.5 A) for a second time period (e.g., the next 500 μsec), gradually adjusting the resistance of the attenuator 103 to allow the current to reach the steady state level for normal operation of the LAM 102 load. At the next opportunity for a second testing cycle, the processor 106 may allow the inrush current to flow for a longer test cycle (e.g., 50 μsec), monitoring a higher peak inrush current (e.g., say 6 A) before controlling the attenuator 103 to apply the resistive load to absorb the inrush current. The processor 106 may repeat the process for several test cycles, each time extending the inrush period until the peak current is ascertained, and thereby determining the inrush time period related to the peak current. With the inrush profile for the driver 104 established, the processor 106 may generate the adapted control signal for attenuator 103 so that the attenuator 103 absorbs the inrush current with an appropriate resistance amount for the inrush time period during all subsequent ON operations for the LAM 102.

The processor 106 may be configured to monitor the current of control circuit 120 during every ON operation so that any change to the driver 104 will be detected, and the control signal can be adaptively adjusted. For example, if the driver 104 is replaced with a new driver, the processor 106 may detect a different inrush profile characteristic (i.e., peak current or inrush period) and run a series of test cycles for the next several ON operations until the new profile is ascertained, and a new control signal can be generated. Upon a subsequent ON operation, the processor 106 may send the stored control signal to attenuator 103 to provide a variable resistance for controlling the inrush current from capacitor 114.

In another embodiment, optional sensor 107 may be arranged in control circuit 120 to sense current through LAM 102, and may provide feedback to the processor 106, allowing adjustments to be made to the control signal. For example, during a testing cycle, as processor 106 gradually adjusts the resistance of attenuator 103, current sensor 107 may send current level indications to processor 106 so that the resistance of attenuator 103 may be controlled instantaneously. The processor 106 may also use current level indications from the sensor 107 to determine the peak inrush current during the testing cycle and/or during normal operation.

Figure 16:
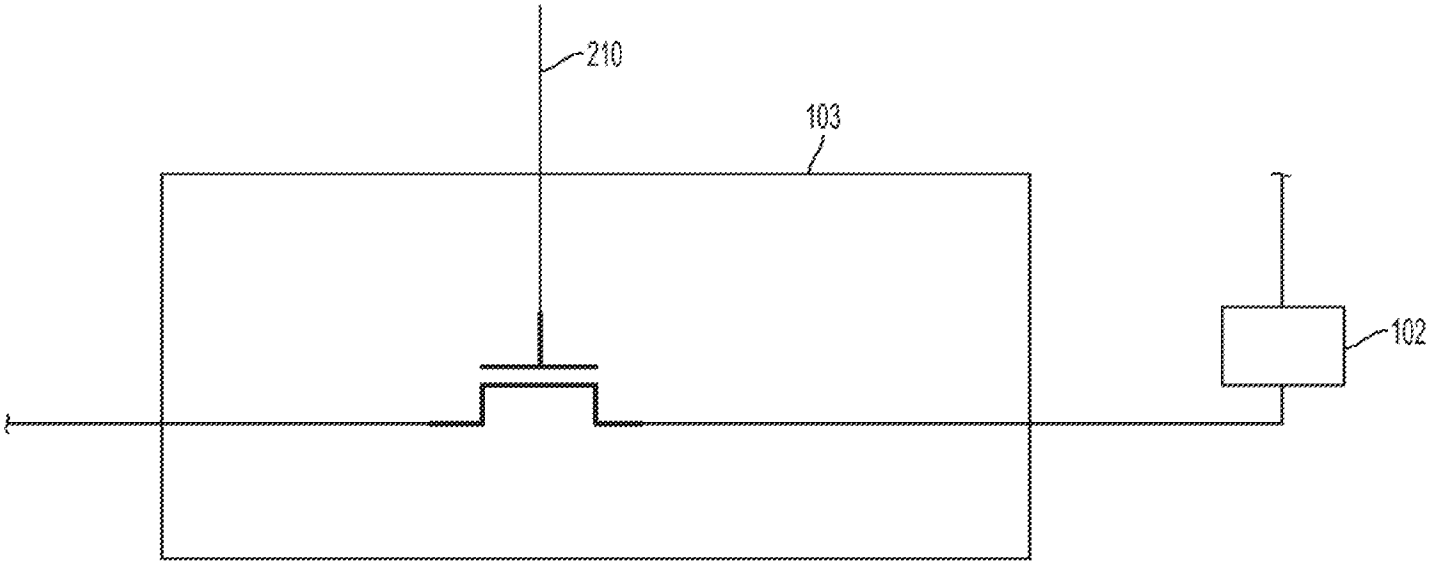
FIG. 16 shows an exemplary attenuator of the control circuit configured as a FET.

FIG. 16 shows an exemplary attenuator 103 configured as a FET. The processor 106 may send a control signal 210 to adjust control voltage to operate the FET within the linear region of operation which controls a variable resistance for attenuator 103 to controllably limit current I to the LAM 102. As the resistance is increased, any excessive inrush current I can be attenuated.

Once the inrush current has been attenuated by the FET in the linear mode of operation after a brief period of time, the processor 106 may control the FET to operate in a saturation region of operation (i.e., the FET is switched to the ON position) to energize the LAM 102 at the regular constant current level. For example, the control voltage 210 may be adjusted to transfer operation of the FET from the linear region to the saturation region.

Figure 17:
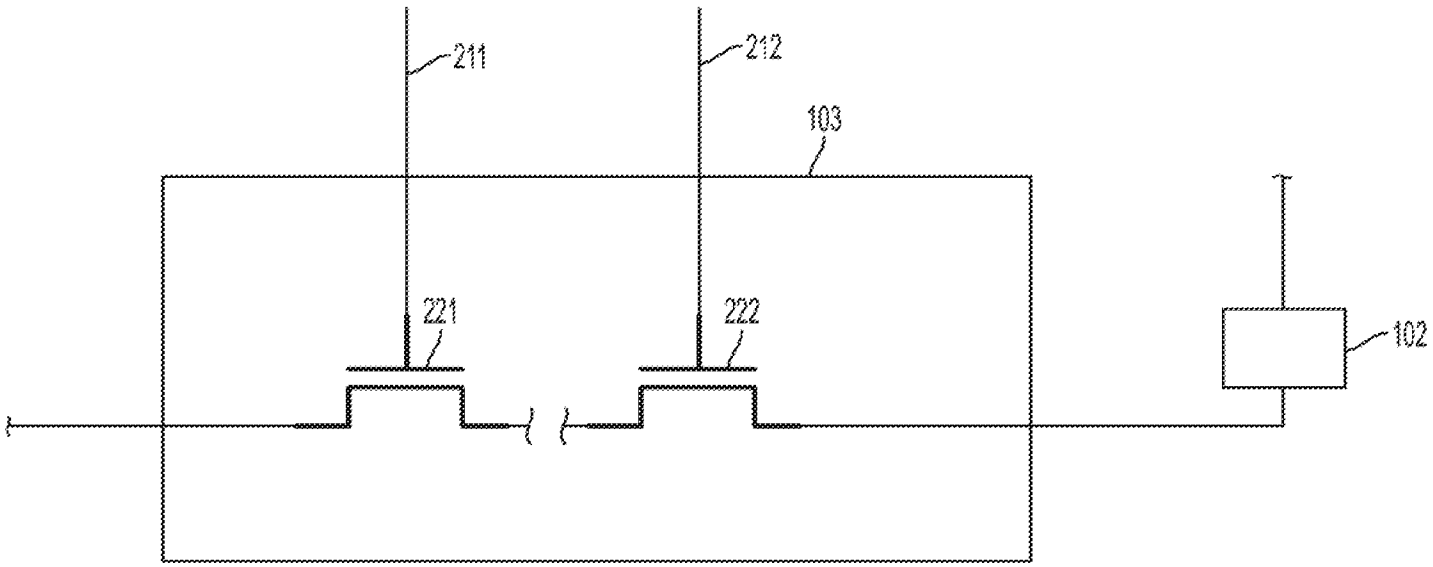
FIG. 17 shows an exemplary embodiment in which the attenuator includes multiple FETs in series to control current to the light emitter.

FIG. 17 shows an exemplary embodiment in which attenuator 103 is configured as multiple FETs 221, 222 in series. In one example, the processor 106 may send a control signal 211 to control FET 221 for ON/OFF control of the LAM 102. For example, the control signal 211 may adjust gate voltage of FET 221 to switch the FET ON and OFF to conduct supply current to the LAM 102. The FET 222 may be configured to attenuate the inrush current to LAM 102 by the processor 106 sending a control signal 212 at the gate voltage. For example, the processor 106 may adjust gate voltage of FET 222 to operate in the linear region with a resistance value that attenuates the inrush current from driver 104 when FET 221 initially switches ON the LAM 102. In another example, multiple FETs 221, 222 may be arranged in series, each controlled by a control signal from the processor 106 such that each FET provides an additional level of control resolution (e.g., each FET may provide a range of attenuation that can be accumulated for the entire attenuation). While two FETs are shown in FIG. 17 for this example, any number of FETs may be implemented as dictated by the amount of desired resolution for current control. In another example, attenuator 103 may include multiple FETs configured to combine the above examples, with a first FET used to control ON/OFF switching of the LAM 102, and multiple FETs to provide an additional level of attenuation resolution.

With respect to the processor 106, examples of processors include microprocessors, microcontrollers, digital signal processors (DSPs), field programmable gate arrays (FPGAs), programmable logic devices (PLDs), state machines, gated logic, discrete hardware circuits, and other suitable hardware configured to perform the various functionality described throughout this disclosure. The processor may execute software. Software shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

Aspects may also be implemented using a combination of both hardware and software. Accordingly, in one or more example aspects, the functions described may be implemented in hardware, software, firmware, or any combination thereof, depending upon the particular application and design constraints imposed on the overall system.

While aspects have been described in conjunction with the example implementations outlined above, various alternatives, modifications, variations, improvements, and/or substantial equivalents, whether known or that are or may be presently unforeseen, may become apparent to those having at least ordinary skill in the art. Accordingly, the example implementations of the invention, as set forth above, are intended to be illustrative, not limiting. Various changes may be made without departing from the spirit and scope of the aspects. Therefore, the aspects are intended to embrace all known or later-developed alternatives, modifications, variations, improvements, and/or substantial equivalents.

Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the term "some" refers to one or more. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. 112(f) unless the element is expressly recited using the phrase "means for", or in the case of a method claim, the element is recited using the phrase "step for."

What is claimed is:

1. An integrated light emitting diode (LED) assembly, comprising:

an LED assembly member having an LED array formed thereon; and an integrated control module (ICM) coupled to the LED assembly member, the ICM comprising a control circuit configured to control current initially applied by an external driver to the LED array in response to a control signal from a processor, wherein the processor is configured to adaptively adjust the control signal when the external driver is replaced with a new external driver, wherein the control circuit further comprises a variable resistor in series with the LED array, wherein the control signal is configured to control the resistance of the variable resistor when current is initially applied to the LED array to control inrush current and to monitor the peak inrush current to generate an inrush current profile for the new external driver.

2. The integrated LED assembly of claim 1, wherein the control circuit further comprises a voltage regulator configured to provide a stepped-down control voltage for the control circuit.

3. The integrated LED assembly of claim 1, wherein the LED array is formed on an upper surface of the LED assembly member.

4. The integrated LED assembly of claim 1, wherein the control circuit further comprises an attenuator configured to attenuate the current initially applied to the LED array in response to the control signal.

5. The integrated LED assembly of claim 4, wherein the attenuator comprises a field effect transistor (FET) configured to switch power to the LED array in response to an ON/OFF control signal from the processor.

6. A lighting module, comprising:

a light emitting diode (LED) array; and a control circuit configured to control current initially applied by an external driver to the LED array in response to a control signal from a processor, wherein the processor is configured to adaptively adjust the control signal when the external driver is replaced with a new external driver, wherein the control circuit further comprises a variable resistor in series with the LED array, wherein the control signal is configured to control the resistance of the variable resistor when current is initially applied to the LED array to control inrush current and to monitor the peak inrush current to generate an inrush current profile for the new external driver.

7. The lighting module of claim 6, wherein the control circuit further comprises a voltage regulator configured to provide a stepped-down control voltage for the control circuit.

8. The lighting module of claim 6, wherein the LED array is formed on an LED assembly member, the LED assembly member being coupled to the control circuit.

9. The lighting module of claim 6, wherein the control circuit further comprises an attenuator configured to attenuate the current initially applied to the LED array in response to the control signal.

10. The lighting module of claim 9, wherein the attenuator comprises a field effect transistor (FET) configured to switch power to the LED array in response to an ON/OFF control signal from the processor.

11. An integrated light emitting diode (LED) assembly, comprising:

an LED assembly member having an LED array formed thereon; and an integrated control module (ICM) coupled to the LED assembly member, the ICM comprising a control circuit configured to control current initially applied by an external driver to the LED array in response to a control signal from a processor, wherein the processor is configured to adaptively adjust the control signal when the external driver is replaced with a new external driver, wherein the control signal is configured to cause the control circuit to allow inrush current from the external driver to flow for a first interval and to monitor the peak inrush current during the first interval to generate an inrush current profile for the driver.

12. A lighting module, comprising:

a light emitting diode (LED) array; and a control circuit configured to control current initially applied by an external driver to the LED array in response to a control signal from a processor, wherein the processor is configured to adaptively adjust the control signal when the external driver is replaced with a new external driver, wherein the control signal is configured to cause the control circuit to allow inrush current from the external driver to flow for a first interval and to monitor the peak inrush current during the first interval to generate an inrush current profile for the driver.

* * * * *